US009803467B2

(12) United States Patent
Tang et al.

(10) Patent No.: US 9,803,467 B2
(45) Date of Patent: Oct. 31, 2017

(54) WELL SCREEN-OUT PREDICTION AND PREVENTION

(71) Applicants: Weiting Tang, Tomball, TX (US); Blake C. Burnette, Tomball, TX (US); Scott G. Nelson, Cypress, TX (US); William D. Holcomb, The Woodlands, TX (US); Yong N. Kang, Tomball, TX (US)

(72) Inventors: Weiting Tang, Tomball, TX (US); Blake C. Burnette, Tomball, TX (US); Scott G. Nelson, Cypress, TX (US); William D. Holcomb, The Woodlands, TX (US); Yong N. Kang, Tomball, TX (US)

(73) Assignee: BAKER HUGHES, Houston, TX (US)

( * ) Notice: Subject to any disclaimer, the term of this patent is extended or adjusted under 35 U.S.C. 154(b) by 419 days.

(21) Appl. No.: 14/661,397

(22) Filed: Mar. 18, 2015

(65) Prior Publication Data

US 2016/0273346 A1 Sep. 22, 2016

(51) Int. Cl.

| | |
|---|---|
| ***E21B 43/04*** | (2006.01) |
| ***E21B 47/06*** | (2012.01) |
| ***E21B 43/267*** | (2006.01) |

(52) U.S. Cl.

CPC ..... *E21B 47/06* (2013.01); *E21B 43/04* (2013.01); *E21B 43/267* (2013.01)

(58) Field of Classification Search

CPC ..... E21B 47/06; E21B 47/00; E21B 44/00; E21B 43/08; E21B 43/00

See application file for complete search history.

(56) References Cited

U.S. PATENT DOCUMENTS 4,393,933 A 7/1983 Nolte et al.
5,105,659 A 4/1992 Ayoub
(Continued)

OTHER PUBLICATIONS

Massaras, L. V., et al, "Real-Time Advanced Warning of Screenouts with the Inverse Slope Method"; In SPE Formation Damage Control International Symposium; (Lafayette, LA, Feb. 15-17, 2012); Proceedings 2012; (ISBN 978-1-61399-180-0; SPE-150263); 3 pages.
(Continued)

*Primary Examiner* — Shane Bomar
(74) *Attorney, Agent, or Firm* — Cantor Colburn LLP

(57) ABSTRACT

A method of monitoring an energy industry operation includes: collecting measurement data in real time during an energy industry operation; automatically analyzing the measurement data by a processor, wherein analyzing includes generating a measurement data pattern indicating the values of a parameter as a function of depth or time; automatically comparing the measurement data pattern to a reference data pattern generated based on historical data relating to a previously performed operation having a characteristic common to the operation; predicting whether an undesirable condition will occur during the operation based on the comparison; and based on the processor predicting that the undesirable condition will occur, estimating a time at which the undesirable condition is predicted to occur, and automatically performing a remedial action to prevent the undesirable condition from occurring.

20 Claims, 5 Drawing Sheets

(56) References Cited

U.S. PATENT DOCUMENTS

| | | | | |
|---|---|---|---|---|
| 5,183,109 | A | 2/1993 | Poulsen | |
| 6,978,831 | B2 | 12/2005 | Nguyen | |
| 8,113,284 | B2 | 2/2012 | Jee et al. | |
| 8,607,864 | B2 | 12/2013 | McLeod et al. | |
| 2004/0040707 | A1 | 3/2004 | Dusterhoft et al. | |
| 2007/0294034 | A1* | 12/2007 | Bratton | E21B 41/00 702/6 |
| 2014/0083680 | A1 | 3/2014 | Brekke | |
| 2015/0286954 | A1* | 10/2015 | Maucec | E21B 44/00 706/11 |
| 2016/0258264 | A1* | 9/2016 | Lesko | E21B 17/20 |
| 2016/0298439 | A1* | 10/2016 | Morrow | E21B 34/06 |

OTHER PUBLICATIONS

Murrey, Michael D., et al., "Fracture Design, Execution, and Evaluation in Retrograde Condensate Reservoirs: Case History of the Angsi Field, Offshore Malaysia";SPE 84395, SPE Annual Technical Conference and Exhibition; Oct. 5-8, 2003; 13 pages.

* cited by examiner

WELL SCREEN-OUT PREDICTION AND PREVENTION

BACKGROUND

Hydrocarbon exploration and energy industries employ various systems and operations to accomplish activities including drilling, formation evaluation, stimulation and production. Measurements such as temperature, pressure and flow measurements are typically performed to monitor and assess such operations. During such operations, problems or situations may arise that can have a detrimental effect on the operation, equipment and/or safety of operators. For example, during stimulation or fracturing operation, screen out conditions can occur, which can cause rapid pressure increases that may compromise the operation and/or damage equipment. Control of the operation to avoid screen outs and other problems is important, specifically to avoid creating conditions that could potentially lead to the problems.

SUMMARY

An embodiment of a method of monitoring an energy industry operation includes: during an energy industry operation, collecting measurement data in real time from a sensor disposed at at least one of a surface location and a downhole location, the measurement data including values of at least one parameter measured during the operation. The method also includes: automatically analyzing the measurement data by a processor, wherein analyzing includes generating a measurement data pattern indicating the values of the parameter as a function of depth or time; automatically comparing the measurement data pattern to a reference data pattern generated based on historical data relating to a previously performed operation having a characteristic common to the operation; predicting whether an undesirable condition will occur during the operation based on the comparison; and based on the processor predicting that the undesirable condition will occur, estimating a time at which the undesirable condition is predicted to occur, and automatically performing a remedial action to prevent the undesirable condition from occurring.

An embodiment of a system for monitoring an energy industry operation includes: a carrier configured to be disposed in a borehole in an earth formation, the carrier including a downhole tool configured to perform an aspect of the operation; and a processor configured to collect measurement data in real time from a sensor disposed at at least one of a surface location and a downhole location, the measurement data including values of at least one parameter measured during the operation. The processor is configured to perform: during the operation, collecting measurement data in real time from a sensor disposed at at least one of a surface location and a downhole location, the measurement data including values of a parameter measured during the operation; and automatically analyzing the measurement data by a processor, wherein analyzing includes generating a measurement data pattern indicating the values of the parameter as a function of time. The processor is also configured to perform: automatically comparing the measurement data pattern to a reference data pattern generated based on historical data relating to a previously performed operation having a characteristic common to the operation; predicting whether an undesirable condition will occur during the operation based on the comparison; and based on the processor predicting that the undesirable condition will occur, estimating a time at which the undesirable condition is predicted to occur, and automatically performing a remedial action to prevent the undesirable condition from occurring.

BRIEF DESCRIPTION OF THE DRAWINGS

The following descriptions should not be considered limiting in any way. With reference to the accompanying drawings, like elements are numbered alike.

DETAILED DESCRIPTION

The systems and methods described herein provide for monitoring, evaluating and/or controlling an energy industry operation, such as a fracturing or stimulation operation, based on predictions of potential undesirable conditions using real time measurement data. The predictions can be used to anticipate and prevent undesirable conditions such as well blockages or screen outs. Historical data from other wells or operations, and/or measurement data taken during the operation, is analyzed to identify patterns or trends in a measured parameter such as fluid pressure. These trends may imply that a future occurrence of a screen out or other undesirable condition is possible or probable. For example, measurement data taken during an operation is processed as a pattern or curve, and is compared (e.g., by curve fitting) to historical data taken from previously performed operations. A match or similarity between a measurement data pattern and a historical data pattern may be interpreted to predict the occurrence and depth or time of a potential undesirable condition.

If trends or patterns in measured data are identified as potentially or likely to result in the development of an undesirable condition, a remedial action may be taken to avoid or prevent the occurrence of such an undesirable condition. In one embodiment, a processing device or system is configured to automatically analyze data, perform predictions, identify potential undesirable conditions and/or take remedial action.

The descriptions provided herein are applicable to various oil and gas or energy industry data activities or operations. Although embodiments herein are described in the context of stimulation and completion operations, they are not so limited. The embodiments may be applied to any energy industry operation. Examples of energy industry operations include surface or subsurface measurement and modeling, reservoir characterization and modeling, formation evaluation (e.g., pore pressure, lithology, fracture identification, etc.), stimulation (e.g., hydraulic fracturing, acid stimulation), drilling, well construction (e.g., cementing), completion and production.

Figure 1:
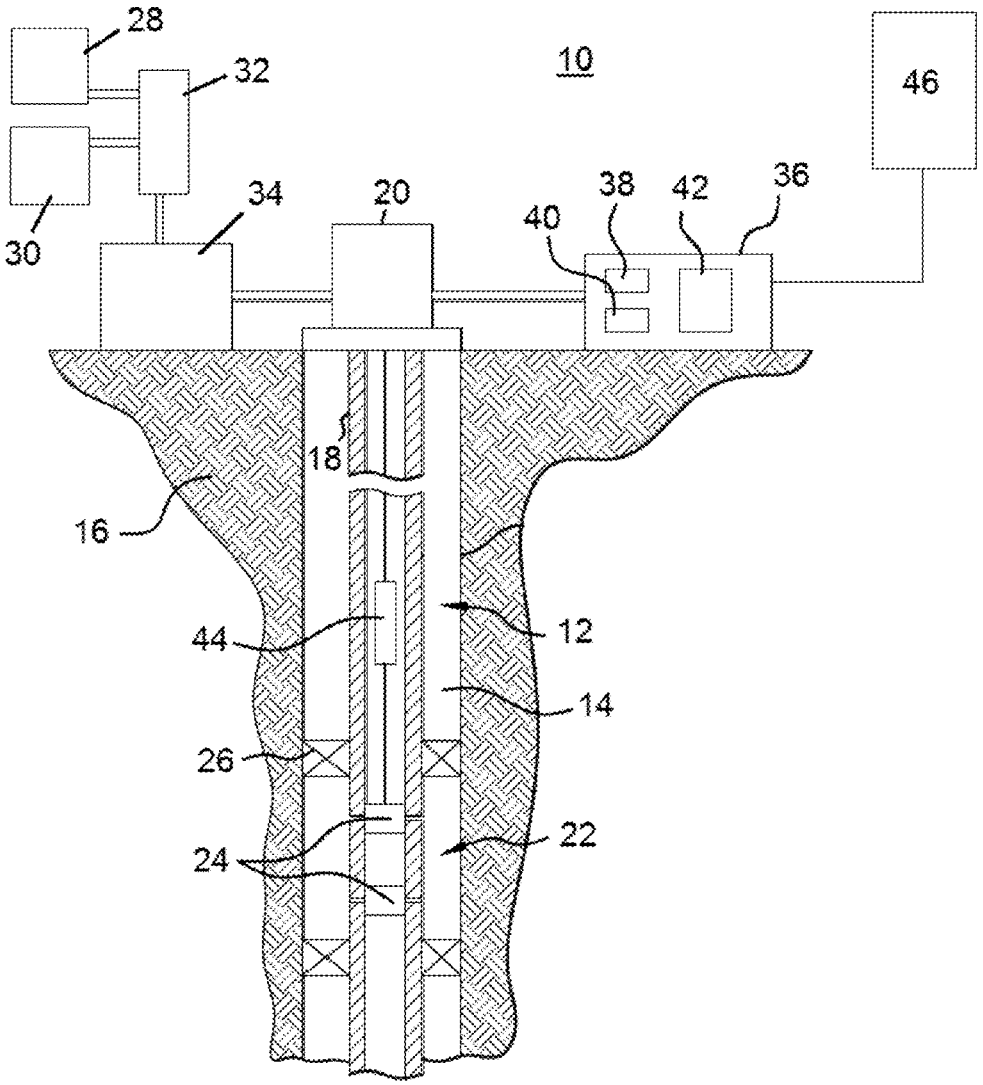
FIG. 1 depicts an embodiment of a system for performing a hydrocarbon production and/or stimulation operation

Referring to FIG. 1, an exemplary embodiment of a hydrocarbon production and/or stimulation system 10 includes a borehole string 12 configured to be disposed in a borehole 14 that penetrates at least one earth formation 16. The borehole may be an open hole, a cased hole or a partially cased hole. The borehole may be vertical, horizontal, or directionally drilled in order to penetrate the target reservoir where oil, natural gas, or other reservoir fluids are located. In one embodiment, the borehole string 12 is a stimulation or injection string that includes a tubular 18, such as a pipe (e.g., multiple pipe segments), wired pipe or coiled tubing, that extends from a wellhead 20 at a surface location (e.g., at a drill site or offshore stimulation vessel).

The system 10 includes one or more stimulation assemblies 22 configured to control injection of stimulation fluid and direct hydraulic fracturing or other stimulation fluid into one or more production zones in the formation. Each stimulation assembly 22 includes one or more injection or flow control devices 24 configured to direct stimulation fluid from a conduit in the tubular 18 to the borehole 14. As used herein, the term "fluid" or "fluids" includes liquids, gases, hydrocarbons, multi-phase fluids, mixtures of two of more fluids, water and fluids injected from the surface, such as water or stimulation fluids. For example, the fluid may be a slurry that includes fracturing or stimulation fluids and/or proppants. In another example, the fluid is a stimulation fluid such as an acid stimulation fluid.

Other components that may be incorporated include perforations in the casing and/or borehole (e.g., incorporated in a frac sleeve), and packers 26, which are typically conveyed downhole and activated to expand when they reach a selected depth to seal the borehole and create isolated regions. Multiple openings and packers can be disposed at multiple depths to create a plurality of isolated regions or zones.

Various surface devices and systems can be included at surface locations. For example, a fluid storage unit 28, a proppant storage unit 30, a mixing unit 32, and a pump or injection unit 34 (e.g., one or more high pressure pumps for use in stimulation and/or fracturing) are connected to the wellhead 20 for providing fluid to the borehole string 12 for operations such as a hydraulic fracturing operation, a stimulation operation, a cleanout operation and others.

The system 10 also includes a surface processing unit such as a control unit 36, which typically includes a processor 38, one or more computer programs 40 for executing instructions, and a storage device 42. The control unit or controller 36 receives signals from downhole sensors and surface devices such as the mixing unit 32 and the pumping unit 34, and controls the surface devices to obtain a selected parameter of the fluid at a downhole location. Functions such as sensing and control functions may not be exclusively performed by the surface controller 36. For example, a downhole electronics unit 44 is connected to downhole sensors and devices and performs functions such as controlling downhole devices, receiving sensor data and communication, and communicating with the controller 36.

The controller 36 may be in communication with other processors, users and storage locations in order to, e.g., send and receive data relating to a current operation or past operations. For example, the controller 36 is connected (e.g., via a network or the Internet) to one or more remote storage locations 46. An example of such a location is a database configured to store data collected from multiple energy industry operations performed in the formation and/or in formations located in other geographical regions.

Figure 2:
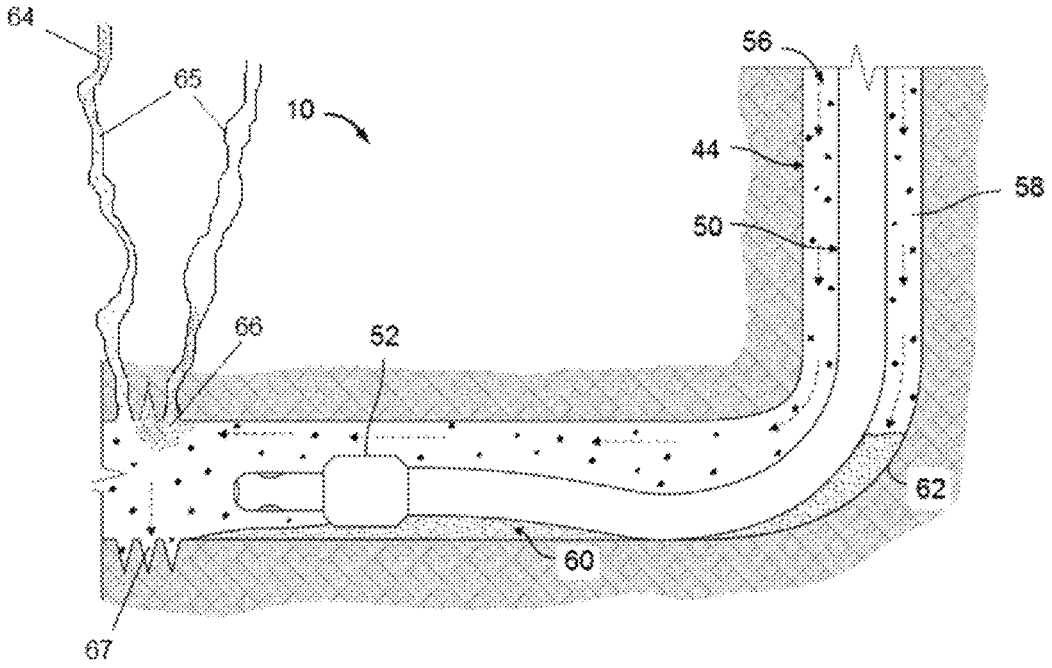
FIG. 2 depicts another embodiment of the system of FIG. 1.

Another example of the system 10 is shown in FIG. 2. In this example, the borehole string 12 includes a coiled tubing 50 that can be extended into the borehole 14, e.g., into a horizontal portion of the borehole 14. The term "horizontal wellbore" refers to horizontal or highly deviated wells as understood in the art. A BHA 52 is connected to the end of the coiled tubing 50 via a connector such as, for example, a "grapple" connector. Although the BHA 52 may take a variety of forms, the BHA 52 in this example includes a sand jet perforating tool. The sand jetting tool of the BHA 52 can be utilized to create perforations. In an exemplary fracturing operation, a fracturing slurry 56 is pumped down annulus 58, during which a first proppant bed 60 may begin to form on the low side of the horizontal portion, and a second proppant bed 62 may begin to form if sand perforating methods are utilized.

A variety of techniques may be used to isolate regions in the borehole 12. For example, as discussed above, packers may be employed to isolate a borehole section. Other techniques include creating or deploying a plug downhole. For example, the perforations can be isolated using a sand plug, which is created by injecting a volume of fluid with elevated sand concentrations, e.g., during the final stage of fracturing slurry injection. Clean displacement fluid is then pumped behind the slurry in order to displace the fracturing slurry into the perforations.

Another method of horizontal wellbore completion includes placing multiple perforation sets, which are sometimes referred to as perforation clusters, at intervals along the lateral wellbore. These multiple perforation sets may be treated at the same time in order to propagate multiple hydraulic fractures away from the wellbore simultaneously. Each group of perforation sets is referred to as a stage, and numerous stages are then stimulated in order to provide hydraulic fractures propagating along the entire length of the horizontal lateral. Typically following each treatment stage, a mechanical bridge plug is deployed into the wellbore to isolate the previously treated stage from the next stage to be perforated and completed.

Various sensing or measurement devices may be included in the system 10, in downhole and/or surface locations. One or more parameter sensors (or sensor assemblies such as LWD subs) are configured to take measurements relating to the formation, borehole, geophysical characteristics and/or borehole fluids. Measurements may be performed downhole and/or at the surface. Examples of parameter sensors include surface pressure sensors (e.g., pump sensors), downhole pressure sensors, flow rate sensors and temperature sensors. Other sensors may be included in the system 10, such as formation evaluation sensors (e.g., resistivity, dielectric constant, water saturation, porosity, density and permeability), sensors for measuring geophysical parameters (e.g., acoustic velocity and acoustic travel time), and sensors for measuring borehole fluid parameters (e.g., viscosity, density, clarity, rheology, pH level, and gas, oil and water contents).

The sensor devices, electronics, tools and other downhole components may be included in or embodied as a BHA, drill string component or other suitable carrier. A "carrier" as described herein means any device, device component, combination of devices, media and/or member that may be used to convey, house, support or otherwise facilitate the use of another device, device component, combination of devices, media and/or member. Exemplary non-limiting carriers include drill strings of the coiled tubing type, of the jointed pipe type and any combination or portion thereof. Other carrier examples include casing pipes, wirelines, wireline sondes, slickline sondes, drop shots, downhole subs, bottom-hole assemblies, and drill strings.

During stimulation or treatment operations, a condition referred to as a screen out may occur that can compromise the operation by restricting fluid flow through a borehole. A screen out occurs when solids injected with a treatment fluid buildup within the created hydraulic fracture, or within the perforations and the area just beyond the wellbore intersecting the formation. For example, as shown in FIG. 2, sand, proppant and/or other solids can cause a build-up 64 of solids within a fracture 65. In addition, a build-up 66 of solids can occur within perforations 67 and/or in a near-wellbore region of the formation. These build-ups can cause a significant and rapid pressure increase.

This bridging of proppant and/or other solids can cause an increase in surface treating pressure that can limit the flow rate of the stimulation treatment. At the point when the surface treating pressure reaches the limitations of the wellbore tubulars, casing, coiled tubing, jointed tubing, etcetera and the pumping rate is curtailed to the degree that the additional placement of proppant into the formation is no longer possible, then a screenout condition is reached. Screen outs typically result in a rapid increase in fluid pressure and/or pump pressure. When the pressure reaches the limitations of the wellbore tubulars and pumping can no longer be accomplished at a rate and pressure beneath the threshold pressure limitation, the well is described as having screened out.

Figure 3:
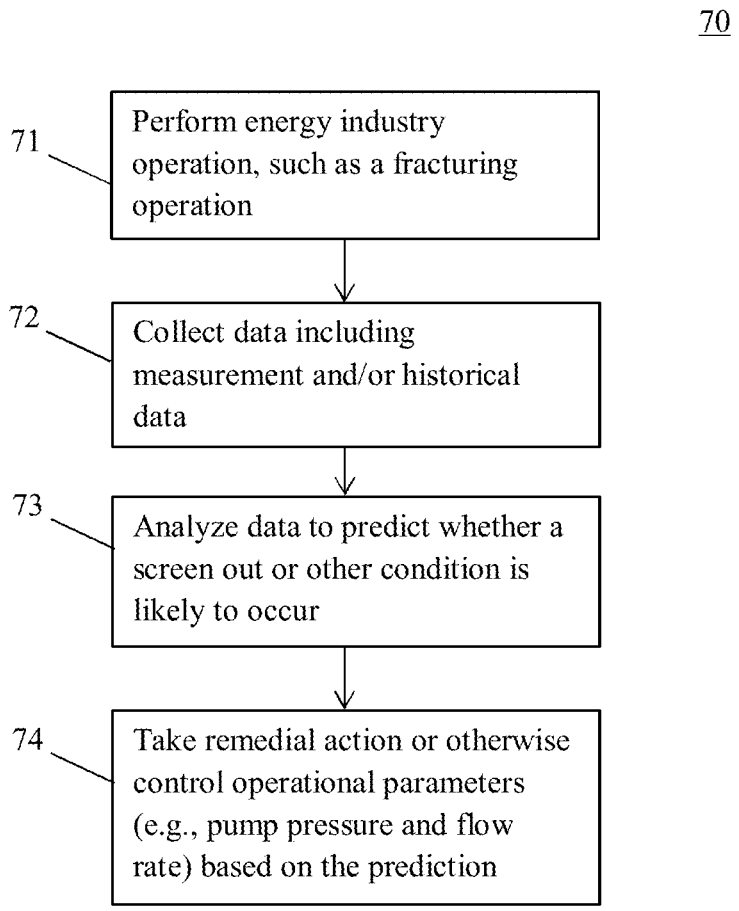
FIG. 3 is a flow chart illustrating an exemplary method of monitoring, evaluating and/or performing an energy industry operation.

FIG. 3 illustrates a method 70 for monitoring, evaluating and/or performing an energy industry operation. The method may be performed by one or more processors or processing units (e.g., the control unit 36) that are configured to receive information and control and/or monitor energy industry operations. The method 70 includes one or more of stages 71-74 described herein. In one embodiment, the method 70 includes the execution of all of stages 71-74 in the order described. However, certain stages 71-74 may be omitted, stages may be added, or the order of the stages changed.

In one embodiment, the method is performed as specified by an algorithm that allows a processor (e.g., the control unit 36) to receive measurement data relating to the operation, receive data from other storage locations, evaluate the operation, provide status information and/or control aspects of the operation. The processor as described herein may be a single processor or multiple processors (e.g., a network). The processor may include multiple individual control or processing units to perform various aspects of the method, such as collecting data, analyzing data and evaluating the operation, and controlling operation parameters.

In the first stage 71, an energy industry operation is planned and performed. For example, a fracturing (also referred to as "fracing") or other stimulation or production operation is performed according to selected operation parameters. The operational parameters include the equipment used, fracturing fluid properties, parameters relating to perforation, planned fluid injection pressures and flow rates, and others.

The fracturing operation described in conjunction with the method 70 is an example of one of a variety of energy industry operations for which the methods described herein can be performed. Other examples of such operations include various stimulation, treatment and/or production operations. Production operations include any operation or process configured to facilitate production of hydrocarbons from a subterranean formation. Treatment operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, friction reducers etc. Illustrative well operations include, but are not limited to, hydraulic fracturing, stimulation, tracer injection, cleaning, acidizing, steam injection, water flooding, cementing, etc. Other examples include fluid injection operations, such as a stimulation, fracturing, clean-out or production operations.

In the second stage 72, data relating to the current operation and/or other operations is collected. Such data includes measurement data taken during the operation and/or historical data related to other similar operations.

Measurement data is taken during the operation, e.g., in real time, and transmitted to a processor for analysis. "Measurement data" as described herein refers to any data generated from measurements taken at the surface and/or downhole before or during the operation. Measurements include measurements of operational parameters and conditions at the surface and/or downhole. Measurements may include one or more of tool depth, tripping speed or rate of penetration, downhole pressure, downhole temperature, downhole fluid properties, produced fluid properties, fluid flow rates, and operational parameters (e.g., pump pressures and flow rates, deployment speed, etc.)

For example, surface measurements such as pump pressure and flow rate, surface pressure and temperature may be taken. Downhole measurements may include fluid flow rate, downhole pressure, downhole temperature, fluid sampling and/or analysis of fluid properties and others. Other measurements may include formation lithology, other formation properties (e.g., permeability), formation fluid properties, downhole pressure and temperature, borehole size and trajectory, and others.

In one embodiment, historical data is collected during the operation or prior to the operation. "Historical data" as described herein refers to data collected from previous operations that provides information relating to previous operations. This data includes, for example, information regarding the location and characteristics (e.g., lithology and reservoir fluid properties) of formations in which the previous operations were performed. Other examples include records of the operational parameters (e.g., fluid types, fluid pressures and flow rates) used during the previous operations, records of conditions measured during the previous operations (e.g., pump pressures, borehole pressures, and borehole temperatures recorded over time), and descriptions of events encountered during the operations. Such events may include any events that had a negative impact on the operation, e.g., screen outs, blowouts, equipment damage, excessive pump or borehole pressures and others. The historical data may be any information relating to previous operations, and is not limited to the specific examples or types of data described herein.

In one embodiment, historical data is collected for previous operations having one or more common or similar characteristics relative to one another and/or relative to the current operation. Such common characteristics include, for example, the location and/or type of formation, and the type of operation performed. For stimulation operations, the common characteristics may include whether the operation is an original stimulation operation or a re-stimulation (e.g., a re-frac operation). For example, if the current operation is a hydraulic fracturing operation, historical data from past hydraulic fracturing operations performed at the same or a similar formation is collected and analyzed. The past operations may be selected based on relatively general similarities (e.g., operation type, formation type), or based on more specific similarities (e.g., duration of operation, type of fluid, pumping/pressure operational parameters, number and depth of fracturing locations, etc.).

In one embodiment, the historical data is collected from a library or database that includes data relating to other operations. For example, a library of borehole treatment execution data for a plurality of operations is accessed. Operations having common characteristics with the proposed operation are selected, and the associated data is collected as a subset of the library data. It is noted that the historical data may be related to past operations performed independently of the current operation, in contrast to diagnostic operations performed in the current formation or current borehole (e.g., pre-fracture tests).

In the third stage 73, the measurement data is analyzed to predict whether a screen out or other undesirable condition may occur or is likely to occur. The measurement data, in one embodiment, is compared to threshold parameters (e.g., curve properties, historical data) to predict whether the undesirable condition will occur and when it will occur.

In one embodiment, the measurement data is collected and associated with time or depth to generate a data set showing the progression of a measured parameter, such as temperature, pump pressure and/or downhole pressure. For example, measured pressure data taken during the current operation is correlated with time to generate a curve or pattern. The measurement data can be fitted to a selected curve and analyzed to predict whether and when a screen out should occur.

Various predictive analytic techniques may be used by the processor to recognize patterns. Examples of such predictive analytics include artificial intelligence techniques (e.g., machine learning), predictive models, decision models, and regression techniques.

In one embodiment, the measurement data is compared to the historical data to predict an undesirable condition. The historical data may be processed to generate a historical curve or pattern that can be associated with an undesirable event.

For example, the historical data is analyzed to recognize patterns in conditions or parameters (e.g., pressure, flow rate and/or temperature) over time that can be associated with undesirable conditions, or that lead up to such conditions. Previous operations that encountered an undesirable condition or problem (e.g., relating to excessive pressure or rate of pressure increases) are analyzed to recognize patterns in the conditions leading up to the problems. For one or more previous operations, measurements of a parameter or parameters are associated with time or depth to generate a pattern or curve, referred to as a historical pattern. A portion of the historical pattern associated with a selected time period is selected or extracted from the historical pattern. The selected time period may be some period of time leading up to the onset of the undesirable condition in the previous operation.

To predict whether an undesirable condition is possible or likely, the measurement data is processed to generate a pattern or curve representing one or more measured parameters as a function of time or depth. This measurement pattern is compared to the historical pattern. If the patterns are sufficiently similar, the undesirable condition is predicted to occur if no action is taken. For example, the measurement data is fit to the historical pattern or curve, and if a portion of the measurement data matches or fits (to within a selected tolerance or error), the processor determines that the undesirable condition is likely to occur.

In one embodiment, if the undesirable condition is determined to be likely, the processor estimates the amount of time before the onset of the predicted condition. This may be estimated by identifying the portion of the historical pattern or curve that matches the measurement data, and calculating the amount of time in the historical data between the matching portion and onset of the condition. The amount of time before the predicted condition may also be estimated based on a rate of change of the measured parameter.

In the fourth stage 74, if analysis of the measured and/or historical data results in the prediction of a screen out or other undesirable condition, the processor performs a remedial action to address or prevent the potential undesirable condition. The processor, in one embodiment, automatically adjusts operational parameters or performs remedial actions to avoid a screen out. For example, the pump pressure or flow rate may be reduced, or pumps may be shut down. In other embodiments, the processor provides information or alerts to a control unit or user to allow the control unit or user to perform appropriate actions.

Figure 4:
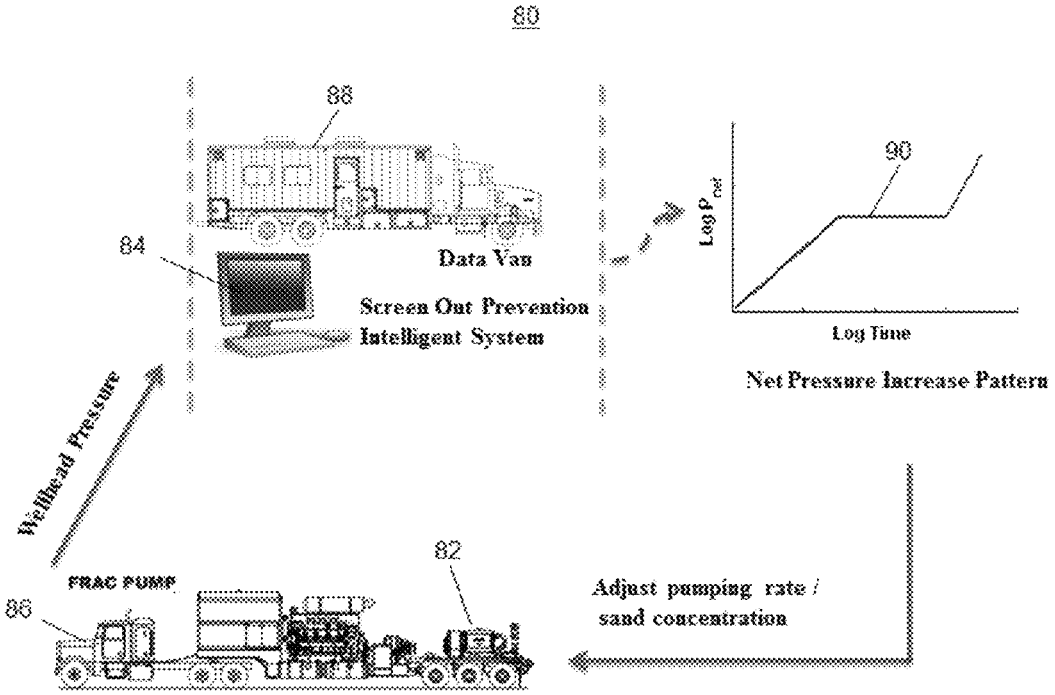
FIG. 4 depicts an exemplary system for controlling a hydraulic fracturing operation and for prediction of screen out conditions during the operation.

FIG. 4 illustrates an example of a hydraulic fracturing system for which the methods described herein can be applied. A hydraulic fracturing system 80 includes surface equipment such as a fracturing pump assembly 82 (referred to as a "frac pump") connected to a processing unit 84. In this example, the frac pump 82 is included in a pump truck 86, and the processing unit is held in a data van 88. The processing unit 84 may perform all of the data collection, analysis, prediction and control functions, but is not so limited. In other embodiments, individual processing units may function in communication with one another. For example, a pump control unit may include processing capabilities to control the frac pump, and a separate prediction unit may be connected in communication (e.g., via a wired or wireless connection or network, or the internet) with the pump control unit, to allow the analysis and prediction functions to be performed remotely and allow the prediction unit to be transported to multiple well sites.

The processing unit 84 receives measurement data from sensors coupled to the frac pump and/or downhole sensors, or from a processing unit that separately collects measurement data. The measurement data is processed to generate a pressure curve 90 which provides a pressure change pattern. In this example, the pressure change pattern is a net pressure (Pnet) increase pattern. Net pressure is defined as the pressure in a fracture or fracture system minus the fracture closure pressure. The net pressure that is applied to the fracturing fluid is the additional pressure over and above the pressure required to simply keep a fracture open. It is then the net pressure that is responsible for fracture propagation and fracture width development.

The pressure change pattern is compared to a threshold or a historical pressure change pattern associated with the onset of a screen out. For example, the historical net pressure values and pattern is compared to the pressure change pattern to determine whether the pressure change pattern is sufficiently similar to the historical pattern. If so, the time window of the historical pattern that matches the measured pattern is found and compared to the time of a screen out event associated with the historical pattern. Matching may be considered to refer to an agreement or similarity between data, such as measurement data having a value falling within some range relative to the historical data, or a measurement data pattern fitting to a historical pattern within some error. In this way, the processing unit 84 determines whether a screen out is likely to occur, and if so, when it will occur (e.g., how many minutes from the time of the latest measurement in the measurement pattern). The processing unit 84 can then directly control the frac pump 82 to automatically change operational parameters such as the pumping rate and/or sand concentration. Alternatively, the processing unit 84 can alert a user or other processor and provide information to allow for appropriate actions to be taken.

Figure 5:
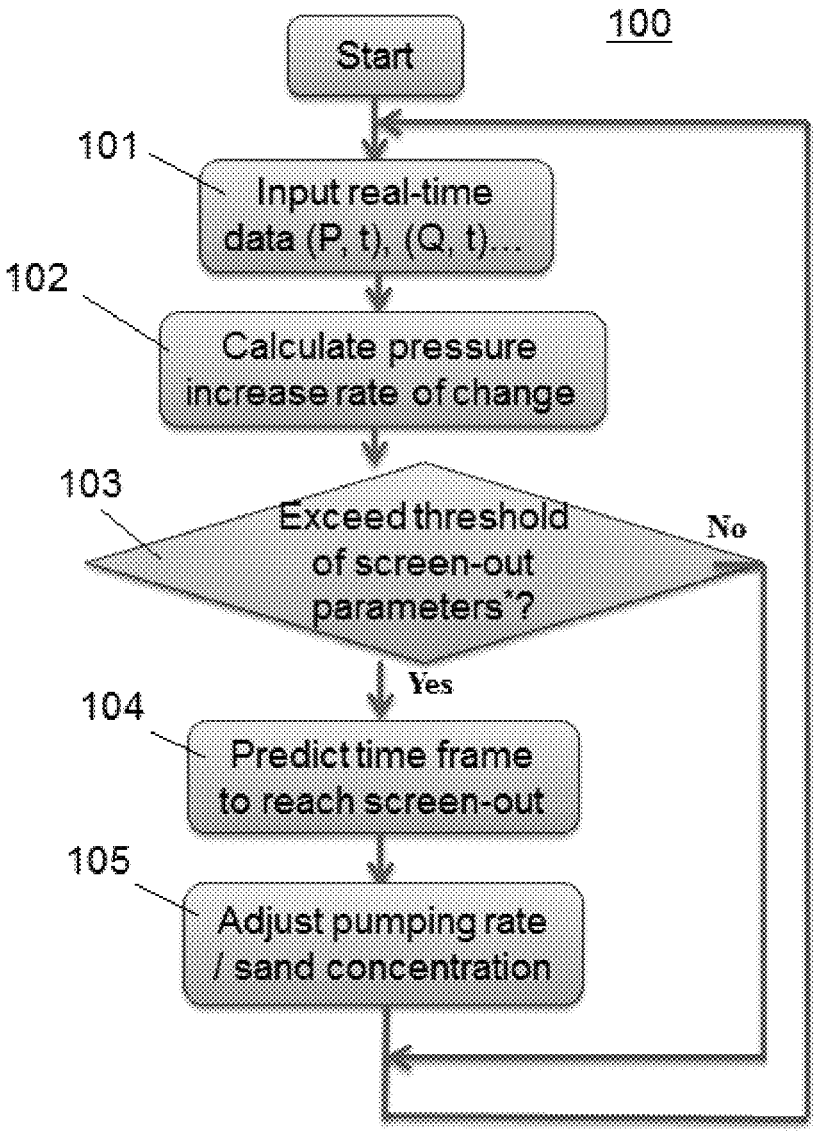
FIG. 5 is a flow chart illustrating an example of the method of FIG. 3, which includes predicting potential screen out conditions during a hydraulic fracturing or other energy industry operation.

FIG. 5 shows an exemplary method 100 of monitoring, analyzing and/or controlling a stimulation operation such as a fracturing operation. In this example, historical data is analyzed to determine the rate of pressure change that precedes a screen out, and/or the rate at different periods prior to the screen out. The method 100 includes one or more of stages 101-105.

In stage 101, a hydraulic fracturing or other stimulation of performed, and parameter measurements are performed. Measurement data is input to a processor in real time. In this example, the measurement data includes pressure over time (P,t) and flow rate over time (Q,t).

In stage 102, the pressure and flow rate data is processed to estimate the rate of pressure increase for each time at which data is measured. This pressure increase may be presented or analyzed as a curve or pattern of pressure increase as a function of time.

In stage 103, the rate of pressure increase is compared to a threshold value. Alternatively, the pressure increase data is fit to a historical pattern. If the pressure increase exceeds the threshold or sufficiently fits the historical pattern, the processor determines that a screen out is likely to occur, and the method proceeds to stage 104. If not, the processor continues to collect measurement data and repeats steps 101-103 during the operation.

In stage 104, the processor calculates the amount of time it will take to reach the screen out condition. This may be calculated based on the rate of pressure increase as compared to historical data or other prior knowledge or experience.

In stage 105, the processor takes remedial action by presenting an alert or warning, and/or adjusting operation parameters such as pumping rate and sand concentration to prevent the screen out from occurring. In some cases, the processor may shut down fluid pumping altogether.

The systems and methods described herein provide various advantages over prior art techniques. Embodiments described herein provide an effective method to anticipate undesirable conditions before they happen, so such conditions can be prevented. Typically, operational parameter changes such as changes to pumping rate, surface sand concentration, treating fluid viscosity, or surface treating pressure take time to be realized downhole, and may thus not be early enough to avoid a screen out or other condition. By anticipating such conditions as described herein, changes can be made earlier and with enough time so that downhole conditions can be affected to address the condition before the condition happens or before it can result in significant damage.

In addition, the embodiments provide automated techniques that can predict problems in advance without having to rely solely on operator experience, and provide a valuable tool to enhance operational performance and compensate for operator inexperience.

Generally, some of the teachings herein are reduced to an algorithm that is stored on machine-readable media. The algorithm is implemented by a computer or processor such as the control unit 36, and provides operators with desired output.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method of monitoring an energy industry operation, comprising:

during the energy industry operation, collecting measurement data in real time from a sensor disposed at at least one of a surface location and a downhole location, the measurement data including values of at least one parameter measured during the operation;

automatically analyzing the measurement data by a processor, wherein analyzing includes generating a measurement data pattern indicating the values of the parameter as a function of depth or time;

automatically comparing the measurement data pattern to a reference data pattern generated based on historical data relating to a previously performed operation having a characteristic common to the operation;

predicting whether an undesirable condition will occur during the operation based on the comparison; and automatically performing a remedial action to prevent the undesirable condition from occurring.

2. The method of claim 1, further comprising, based on the processor predicting that the undesirable condition will occur, and estimating a time at which the undesirable condition is predicted to occur.

3. The method of claim 1, wherein the operation is a stimulation operation, the measurement data pattern includes a pressure profile, and the undesirable condition includes a screen out condition.

4. The method of claim 1, wherein comparing includes performing a curve fit of the measurement data pattern to the reference data pattern.

5. The method of claim 1, wherein the performing the remedial action includes presenting operational action changes in order to avoid occurrence of the undesirable.

6. The method of claim 1, wherein the historical data is from one or more previously performed operations that experienced the undesirable condition, and the reference data pattern includes parameter values measured during a time period leading up to occurrence of the undesirable condition.

7. The method of claim 1, further comprising collecting the historical data by accessing a database of energy industry operation data, identifying a subset of data associated with one or more operations having the common characteristic, and generating the reference data pattern based on the subset.

8. The method of claim 1, wherein the reference data pattern includes a curve representing parameter values associated with the previously performed operation during a time period leading up to occurrence of the undesirable condition.

9. The method of claim 1, wherein analyzing includes identifying a time value associated with a portion of curve that matches the measurement data pattern, determining an amount of time that elapsed between the time value and a time at which the undesirable condition occurred in the previously performed operation, and predicting when the undesirable condition will occur in the operation based on the amount of time.

10. The method of claim 1, wherein the collecting includes collecting surface measurement data in real time during a stimulation operation from one or more pressure and flow rate monitoring sensors disposed at a surface location, the surface location including at least one of: a location associated with stimulation fluid blending equipment, a location associated with pumping equipment and a location associated with a high pressure injection line.

11. A system for monitoring an energy industry operation, comprising:

a carrier configured to be disposed in a borehole in an earth formation, the carrier including a downhole tool configured to perform an aspect of the operation; and a processor configured to collect measurement data in real time from a sensor disposed at at least one of a surface location and a downhole location, the measurement data including values of at least one parameter measured during the operation, the processor configured to perform:

during the operation, collecting measurement data in real time from a sensor disposed at at least one of a surface location and a downhole location, the measurement data including values of a parameter measured during the operation;

automatically analyzing the measurement data by a processor, wherein analyzing includes generating a measurement data pattern indicating the values of the parameter as a function of depth or time;

automatically comparing the measurement data pattern to a reference data pattern generated based on historical data relating to a previously performed operation having a characteristic common to the operation;

predicting whether an undesirable condition will occur during the operation based on the comparison; and automatically performing a remedial action to prevent the undesirable condition from occurring.

12. The system of claim 11, wherein the processor is further configured to perform, based on the processor predicting that the undesirable condition will occur, estimating a time at which the undesirable condition is predicted to occur.

13. The system of claim 11, wherein the operation is a stimulation operation, the measurement data pattern includes a pressure profile, and the undesirable condition includes a screen out condition.

14. The system of claim 11, wherein comparing includes performing a curve fit of the measurement data pattern to the reference data pattern.

15. The system of claim 11, wherein the parameter is a fluid pressure, and the reference data pattern is a pattern of pressure increase associated with the undesirable condition.

16. The system of claim 11, wherein the historical data is from one or more previously performed operations that experienced the undesirable condition, and the reference data pattern includes parameter values measured during a time period leading up to occurrence of the undesirable condition.

17. The system of claim 11, wherein the processor is configured to collect the historical data by accessing a database of energy industry operation data, identifying a subset of data associated with one or more operations having the common characteristic, and generating the reference data pattern based on the subset.

18. The system of claim 11, wherein the reference data pattern includes a curve representing parameter values associated with the previously performed operation during a time period leading up to occurrence of the undesirable condition.

19. The system of claim 18, wherein analyzing includes identifying a time value associated with a portion of curve that matches the measurement data pattern, determining an amount of time that elapsed between the time value and a time at which the undesirable condition occurred in the previously performed operation, and predicting when the undesirable condition will occur in the operation based on the amount of time.

20. The system of claim 11, wherein the remedial action includes automatically adjusting the operation to avoid the undesirable condition.

* * * * *